United States Patent [19]

Schmidt

[11] 4,329,854

[45] May 18, 1982

[54] MAINTENANCE AND PROTECTION DEVICES FOR COOLING PLANTS

[75] Inventor: Manfred Schmidt, Berlin, Fed. Rep. of Germany

[73] Assignee: Erich Schultze KG. Alt-Heiligensee 44, Berlin, Fed. Rep. of Germany

[21] Appl. No.: 171,186

[22] Filed: Jul. 22, 1980

[30] Foreign Application Priority Data

Jul. 26, 1979 [DE] Fed. Rep. of Germany ..... 2930404

[51] Int. Cl.[3] ..... F25B 43/02

[52] U.S. Cl. ..... 62/470; 62/84; 62/513

[58] Field of Search ..... 62/468, 470, 471, 84, 62/513

[56] References Cited

U.S. PATENT DOCUMENTS

| | | | |
|---|---|---|---|
| 2,701,684 | 2/1955 | Hirsch | 62/468 |
| 3,084,523 | 4/1963 | Bottum et al. | 62/468 |
| 3,177,680 | 4/1963 | Rusovich et al. | 62/471 |
| 3,212,289 | 10/1965 | Bottum | 62/296 |

FOREIGN PATENT DOCUMENTS

| | | |
|---|---|---|
| 1932649 | 11/1965 | Fed. Rep. of Germany . |
| 743550 | 1/1956 | United Kingdom . |
| 1105971 | 3/1968 | United Kingdom . |
| 1554346 | 10/1979 | United Kingdom . |

*Primary Examiner*—Ronald C. Capossela

*Attorney, Agent, or Firm*—Cushman, Darby & Cushman

[57] ABSTRACT

The single circuit refrigeration plant includes a housing which provides three concentrically located contiguous compartments including a first one interposed between the pressure side of the compressor and the condenser, a second one interposed between the first and the third, the third compartment being interposed between the second compartment and the evaporator. The first compartment is axially centrally located; it is directly ringed by the third compartment and is also ringed by the second compartment. In use, as the compressed gas stream enters the first compartment the pressurized oil therein separates therefrom and the resultingly de-oiled compressed gas stream flows to and through the condenser, through the fluid collector, to and through the evaporator to the third compartment in which it separates into a further liquid component which is combined with the degassed oil in the second compartment, and the remaining gas stream is returned to the suction side of the compressor, meanwhile: the oil degassed and collected in the second compartment is cooled at least in part by indirect heat transfer by contact with the third compartment and is returned to the compressor.

4 Claims, 8 Drawing Figures

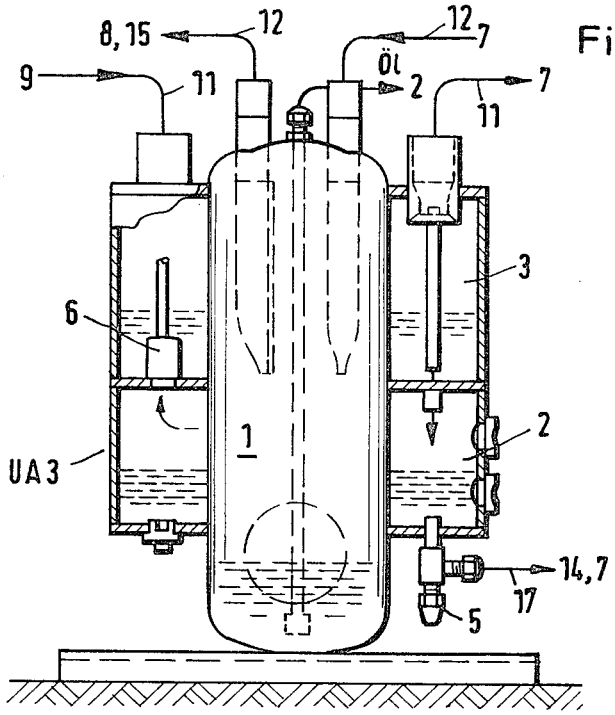
Fig. 5
Fig. 6
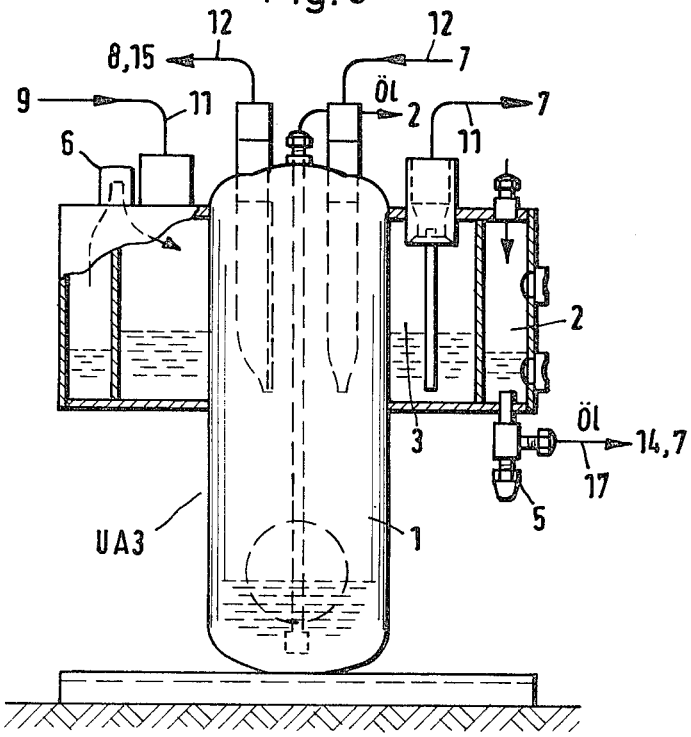

MAINTENANCE AND PROTECTION DEVICES FOR COOLING PLANTS

FIELD OF THE INVENTION

The invention relates to a supply and protective device for refrigeration plants, especially for compressor refrigeration plants.

BACKGROUND OF THE INVENTION

Separate oil-separators, oil degasification-/ oil collecting vessels, fluid traps as well as fluid collectors have been known in refrigeration plants.

The invention is based on the task of developing a device of the initially stated type in such a way that it may be applied universally, needs little space and ensures an economical and energy favorable operation of the refrigeration plant and takes care essentially of a systematic and sure operational return of oil and protects just as effectively against fluid impact.

SUMMARY OF THE INVENTION

According to the invention, devices with at least two operative spaces, disposed mutually concentrically, are provided, whereby different functions may be assigned to these operative spaces. Preferred embodiments of the invention are devices with three and four operative spaces.

In case of a device with at least two operative spaces the operational processes of "separating oil from the compressed gas stream" and "oil degasification of the return oil", or instead of the latter "separating of fluid from the producer gas stream" may take their course, or the operational processes may also be provided in different combination in case of devices with three and four operational spaces, whereby the function of "collecting fluid of the condensor freezing mixture fluid" is added.

The operational spaces separate the circulation media, however the operational spaces are so disposed relative to one another, that a favorable mutual influencing results. The device fulfills universal, overwhelmingly separating functions. The disposal of the operational spaces is determined according to economics, constructions, functional and thermodynamic points of view, whereby the constructional design with operational spaces disposed concentrically side by side and on top of one another, represents an optimum. In this case supply and protective effects are partly interconnected.

In the following pages the listed abbreviations will be used for the individual functions:

Separating oil from the compressed gas stream = OeS

Oil degassification of this return oil = E

Fluid separation from the production gas stream = FA

Fluid collection of the condensor-freezing mixture fluid = FS

The multiple supply effects of the device with four operational spaces are:

1. Effective, nearly complete separation of the refrigeration engine oil from the compressed gas volume stream of the compressed gas line in the OeS operation space by corresponding construction elements (filter body, baffle plate) and volume-size according to function, as well as oil return according to operation (floating ball-mechanism) in the E-operation space, whereby type and position of the feed is codetermined by the degassing task (gas space, distance to the oil level and to the degassing line, which are also characteristics of the invention).
2. Effective degassing of the return oil in the E-operating space by pressure release via a degassing arrangement (for example degassing valve with successive steam dome and pressure section for continuous degassing effect, also characteristics of this invention) as well as sufficient oil supply. Cooling of the fed-in return oil in the feed line (as smooth pipe, ribbed pipe or coil) in the area of the FA operation space, but also by its cooling effect on the stored oil in the E-operation space, assuming corresponding constructional coordination as additional inventive characteristics. Pressure-constant return of the degassed and cooled-down oil to the crank pit of the refrigeration compressor via an oil-level regulator(floating ball mechanism) provided thereon.

This entire selfcontained course of the oil separation, float-regulated oil return, degassing and cooling-down under thermally favorable influences, in brief, favorable transitions of flow within this apparatus is likewise a characteristic of the invention.

It represents an optimum both from a constructional, but also from a functional point of view, for in this device the oil is separated at a high degree of effectiveness (saving energy, since only the significant residual oil takes energy from the refrigerating medium and is transported through the refrigerating circuit and influences the degree of effectiveness of the refrigerating plant negatively, also any shifting of oil and damage is returned in a quantity mechanically controlled (safely), is then degassed immediately (oil frothing in the refrigerating compressor and any damage resulting from it will therefore be avoided) and is cooled down at the same time (therefore unnecessary heating up of the compressor bearings is thus averted).

This apparatus thus represents a desirable supply arrangement with several protective effects for the refrigerating compressor, particularly because a complete oil supply is achieved.

Refrigeration engine oil returned from the stream of compressed gas, usually contains dissolved refrigerating agent. During start and in operation of the refrigerating compressors damage to the compressor often results from this (fluid impact, valve-tongues, even breakage of valve plates, damage in storage, etc.).

Therefore, crank-pit heaters (electric) or pumping down circuits are customarily provided as a precaution, in order to drive out or suck-out the refrigerant dissolved in the oil. This costs additional power and partly a greater use of devices.

The hot refrigerating engine oil ($t_{Oes} > t_E$) separated in the OeS operating space for example by way of filters and baffle plates is conducted for example by way of a mechanical float valve to the E-operation space. As a result of the effect in the E-space and the heat flow from the OeS space, corresponding constructional space coordination and assuming the shaping of the heat exchange surface, and corresponding constructional space correlation and forming of the heat exchange surface the following thermo-dymanic effect connected with the invention will be achieved:

Degassing by pressure release ($pE < POeS$), essentially supported by thermal driving-out of gas ($gOeS \rightarrow gE$).

As a result of thermal influence of the FA-space ($t_{FA}<t_E$), but also by corresponding passing through pipes through the FA space, or else by guiding into an additional space connected with the ambient air ($t_R<t_E$), an important, thermodymanic reciprocal effect will be achieved moreover, since the return oil is advantageously cooled down, and the liquid separated in the FA-operation space and the production gas, flowing through the former is heated up advantageously.

For this purpose corresponding constructional disposal of the operating spaces, the components, the use of for example, heat conductive but also thermally insulating surface areas, also for example variable assignment of the spaces, of the components and the connections are postulated (in case of the FA-space, for example, the heating of the producer gas is controlled by variable position of the connections, which is also a special characteristic of this invention).

Multiple protective effects of the device with four operating spaces:

1. Effective, reliable separation of the fluid moved to the producer-gas side or carried along by the producer-gas volume (freezing mixture, residual oil or their mixtures) and moreover their continuous, mist-like therefore properly protective return (by way of Venturi tube with pipette) from the FA operating space with systematic volume to the refrigerating compressor through its producer-gas volume-stream. As a result of that the following injuries to the compressor will be effectively avoided on the basis of this system:
   Shrinking -on of the bearings (undercooling)
   Fluid impacts (hammering of the pistons, breaking of the operating valves, pistons, eccentric or crank shafts, tearing of gaskets)
   Impeding the lubricating oil supply (formation of oil foam, damage to bearings).
   The systematic volume, as a function of the refrigeration performance and of the plant size, will be achieved for fairly large received quantities of separated fluid by parallel connection of a correspondingly large container via communicating pipes towards the FA operating space.
2. Effective undercooling (tu<t) of the freezing mixture fluid in the FS operating space emerging from the condensor via the fluid line, especially as a result of the cooling effect of the FA operating space, assuming the effective correlation of both operating spaces.
   The undercooling has the following advantages and protective effects for the plant operation:
   (a) No pre-evaporation (possible consequences: cavitation, hammering of the expansion valve) in case of standard loss of pressure in the fluid line.
   (b) No pre-evaporation in case of an extended fluid line.
   (c) Increase of the refrigerating capacity (greater enthalpy-difference).

Beside these protective effects and the improvement of the performance of the refrigerating plant, the positive thermo-dynamic interaction of both operating spaces should be noted. As a result of the heat flow from the FS operating space to the FA operating space, assuming corresponding structural correlation, not only the fluid in the FS operating space is cooled down, but the producer gas volume stream and the separated fluid (freezing mixture, residual oil and their mixtures), guided through the FA operating space are heated up advantageously (tFL, toh>to).

Advantages: Low viscosity of the oil-freezing agent mixture sucked-in from the FA operating space even in case of low temperature operation, also not too low a producer gas input temperature in the refrigerating compressor, the heating up the producer gas volume stream in the FA operating space may be influenced by the distance and the position of the inlet and outlet, which is also a characteristic of this invention. The systematic volume as a function of the refrigerating performance and size of plant is achieved for fairly large fluid receptions by parallel connection of a correspondingly large container via communicating pipes towards the FS operating space.

The described multiple effects have hitherto not become known as a work cycle in a closed construction unit, with the complex, favorable thermodynamic reciprocal effects, resulting therefrom.

Additional thermodynamic effects, functions and extremely favorable operating processes characterize this invention not only as a new technique, but also as a desirable, complete supply and protective arrangement for the reliable oil supply of refrigeration compressors for the ensured protection against fluid impacts on the suction side (UVV-requirement—accident prevention rule) and beyond that because of additional supply and protective tasks, already described, as a central and universal device with many advantages of construction and plant.

The devices may be developed in a corresponding manner with two and three operating spaces, whereby always two or three of the functions described before are assigned to the operating spaces. Here, various combinations of functions are possible.

The devices are therefore suited for universal use in supply and protection in refrigerating plants and for a just as effective protection against fluid impacts, especially for compressor refrigerating plants, single circuit or combination refrigerating plants, in single, double or multiple step construction or in cascade connection.

The building and connection structure of the devices resulting from the invention, permits moreover a simple connection or a simple accommodation of control and/or signal arrangements in the corresponding operating spaces in order to record fluid levels or to regulate them. The new technique of this invention, its functional and operational advantages appear in an unexpected way in case of its use in combination refrigerating plants.

Embodiments of the invention will be described in more detail subsequently, on the basis of the drawings.

BRIEF DESCRIPTION OF THE DRAWINGS

FIG. 5 is a schematic representation of the apparatus that is diagrammed in FIG. 4;

FIG. 6 is a schematic representation of a modified form of the apparatus of FIG. 5;

DETAILED DESCRIPTION OF THE PRESENTLY PREFERRED EMBODIMENTS

In the figures the numeral 1 designates an operating space for oil separation from the stream of compressed gas, 2 is an operating space for oil degassing of this return oil, 3 for separating fluid from the producer gas stream and 4 is an operating space for collecting fluid of the condensor freezing agent fluid, whereby the individual operating spaces may also assume some other mutual arrangement.

Figure 1:
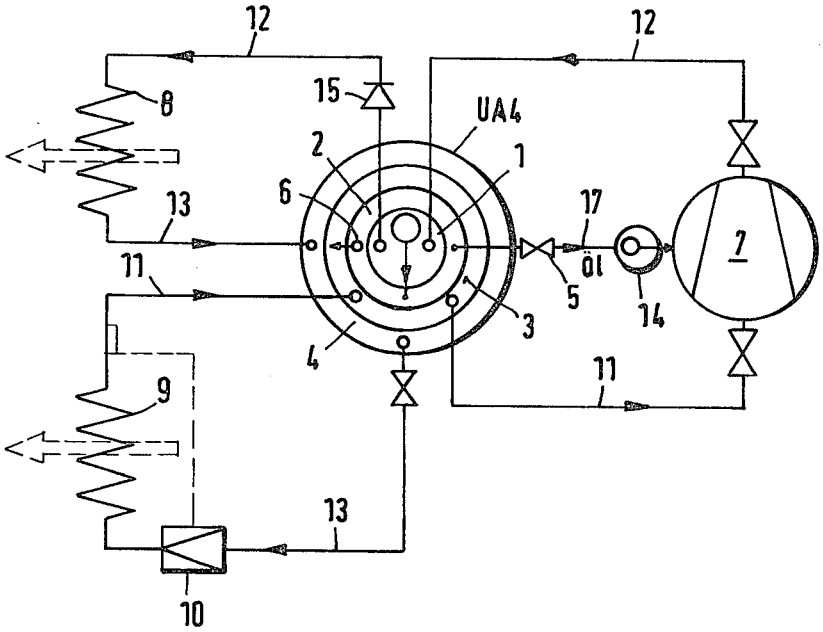
FIG. 1 is a flow diagram of a single circuit refrigeration plant with a single stage compressor and four concentrically arranged operating spaces.

FIG. 1 shows the flow diagram of a single circuit refrigerating plant with single stage compressor (7) and device UA4 (four functions). For the operating spaces OeS (1), E (2), FA (3) and FS (4) the following working interrelation result therein:

The stream of freezing mixtures of the refrigerating circuit produced by the refrigerating compressor (7), enters at first as a compressed gas volume stream (V) via the pressure gas line (12) into the OeS operating space (1).

There the compressor oil carried along by the pressure gas-volume stream is almost entirely separated and is conveyed into the E-operating space (2) under pressure gas pressure (p) in the rythm of operationally obtained quantities.

Here, the pressure gas dissolved in oil is relaxed at a lower pressure ($(po+\Delta p)<p$) and is carried off to the FA operating space (3) via a degassing valve (6). The oil degassed and stored in the E-operating space (2) is cooled off by the cooling action of the FA operating space (3) ($tFA<tE$).

The pressure gas volume stream (V) reaches the condensor (8) from the OeS operating space (1) via a series connected return valve (15) in the pressure gas line (12). The freezing mixture fluid emerging there moves via the fluid line (13) into the FS operating space (4), where it is undercooled by the cooling action of the FA operation space (3) and of the ambient air.

The undercooled freezing mixture fluid flows from the FS operating space (4) through the fluid line (13) to the cutoff valve (10), where it relaxes to evaporation pressure (po) and is injected into the evaporator (9).

The evaporated freezing mixture enters the FA-operation space (3) as a producer-gas volume stream (Vo) via the producer gas line (11). Here the liquids, carried along by the producer gas volume stream or which moved away from the direction of the fluid side (freezing mixture, residual oil or their mixtures) are effectively separated and collected. These fluids are continuously sucked off in a protective form by the refrigerating compressor (7) via the producer gas line (11) with the emerging producer gas volume stream.

The degassed and cooled down return oil, stored in the E-operating space (2), reaches the crank pit of the refrigerating compressor (7) under constant differential pressure ($\Delta p$) through an outlet-shut-off valve (5) and an oil return line (17) by way of an oil-level regulator (14).

Figure 2:
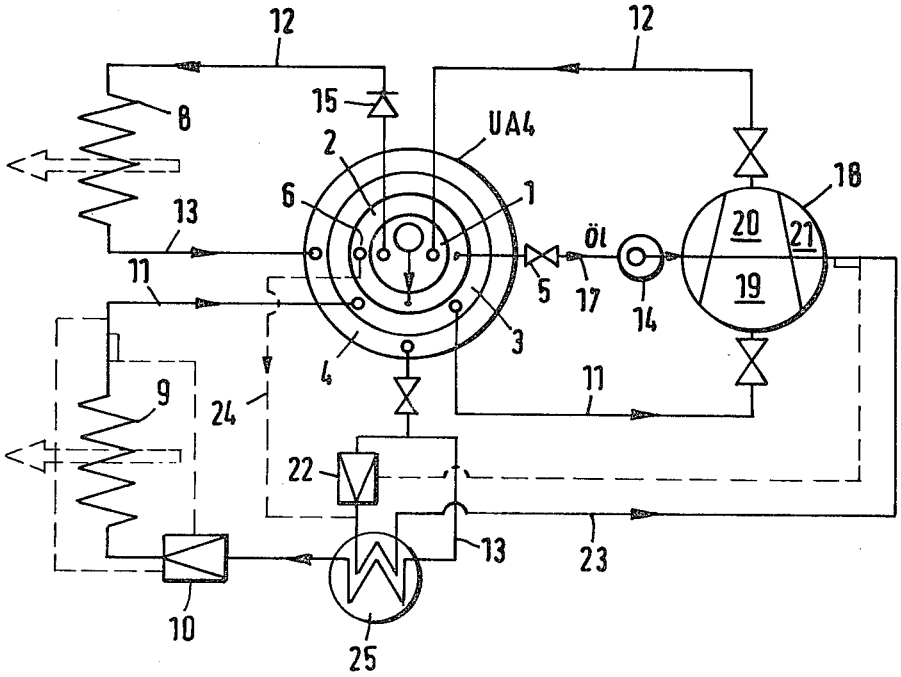
FIG. 2 is a flow diagram of a single circuit refrigeration plant with a two-stage compressor, a fluid undercooler and four concentrically arranged operating spaces.

FIG. 2 shows the flow diagram of a single circuit refrigerating plant with a two stage compressor (18), fluid undercooler (25) and device UA4. An active correlation analogeous to the one described under FIG. 1 for the operation spaces OeS (1), E (2), FA (3) and FS (4), whereby the following effects connected with the two-stage operating must be taken into consideration: The pressure gas volume stream (V) enters from the high pressure stage (20) into the refrigerating circuit, the producer-gas volume stream (Vo) is produced by the low pressure stage (19) of the two stage refrigerating compressor (18). In this case almost mean pressure (pm) prevails in the crank pit, since there is a connection to the mean pressure area (21). This causes a pressure ($(pm+\Delta p)<p$) greater than the mean pressure (pm) in the E-operating space (2). By degassing toward the mean pressure area (21) this will be achieved. The degassing line (24) is connected for this purpose with the fluid-injection line (23) between cutoff valve (22) for the intermediate injection and fluid undercooler (25).

Figure 3:
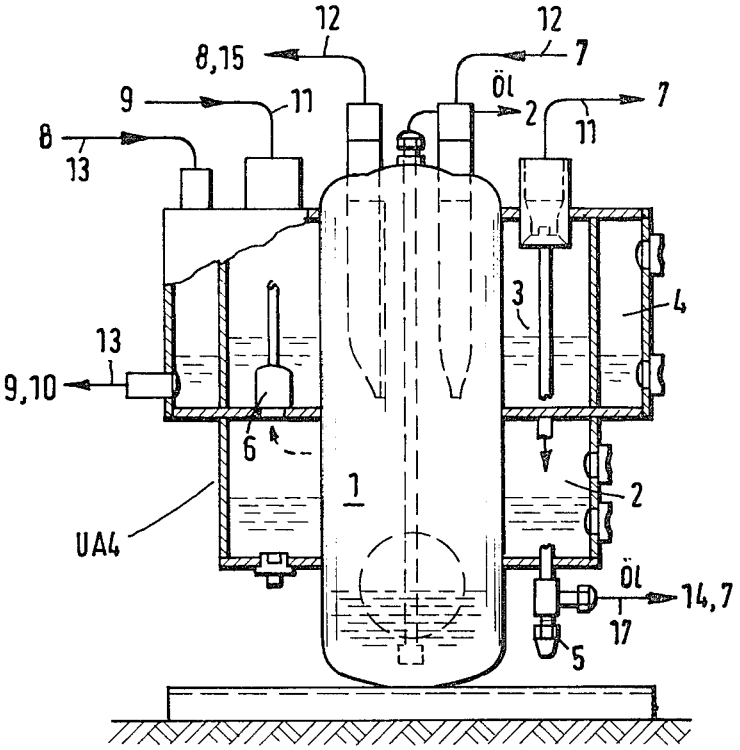
FIG. 3 is a schematic representation of the apparatus that is diagrammed in FIG. 1.

FIG. 3 shows the embodiment of a constructed device UA4 with an operating spaces system (Oes (1), E (2), FA (3), FS (4)) and active correlations as described under FIG. 1.

Figure 4:
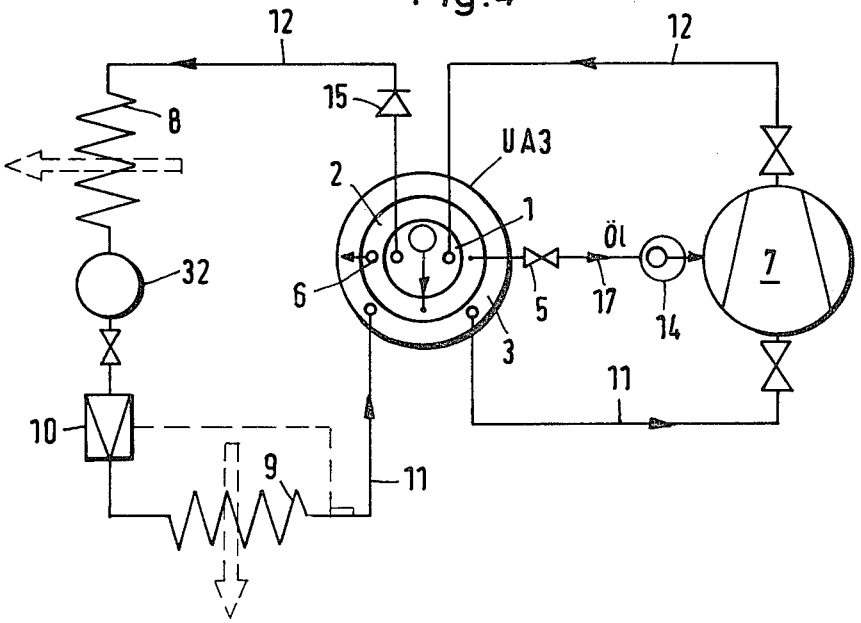
FIG. 4 is a flow diagram of a single circuit refrigeration plant with a one-stage compressor and three concentrically arranged operating spaces.

FIG. 4 shows the flow diagram of a single circuit refrigerating plant with one stage compressor (7) and device UA3 for the three operating spaces of which the functions contents OeS (1), E (2) and FA (3) are made the basis. Thus the following effective correlations result:

The stream of freezing mixture of the refrigerating circuit, produced by the refrigerating compressor (7) enters at first as pressure gas volume stream (V) by way of the pressure gas line (12) into the OeS-operating space (1). The compressor oil, carried along by the pressure gas volume stream is almost completely separated and is conveyed into the E-operating space (2) under pressure gas pressure (p) in a quantity obtained in the rythm of the operation. Here, the pressure gas dissolved in the oil is relaxed at a low pressure ($(po+\Delta p)<p$) and is carried off to the FA-operating space (3) via a degassification valve (6). The oil degassed and stored, in the E-operating space (2) is cooled down by the cooling action of the FA-operating space (3) ($tFA<tE$).

The pressure gas volume stream (V) reaches the condensor (8) from the OeS operating space (1) via a series connected non return valve (15) in the pressure gas line (12). The freezing mixture fluid emerging there is absorbed by the following plant fluid collector (32) and is undercooled by the ambient air. The undercooled freezing mixture fluid continues to flow to the cutoff valve (10), where it is relaxed to evaporation pressure (po) and is injected into the evaporator (9).

The evaporated freezing mixture enters the FA operating space (3) via the producer gas line (11) as a producer gas volume stream (Vo). Here the fluids (freezing mixture, residual oil or their mixtures) carried along by the producer gas volume stream or moved away from the direction of the fluid side, are separated effectively and collected. These fluids with the emerging producer gas volume stream are continuously sucked off in a protective form by the refrigerating compressor (7) via the producer gas line (11).

The degassed and cooled down return oil stored in the E-operating space (2) reaches the crank pit of the refrigerating compressor (7) under constant differential pressure ($\Delta p$) through an outlet and cutoff valve (5) and oil return line (17) via an oil level regulator (14).

FIG. 5 shows the embodiment of a constructed device UA3 with operating-spaces system (Oes (1), E (2), FA (3)) and effective correlations, as described under FIG. 4.

FIG. 6 shows another embodiment of the device UA3.

Figure 7:
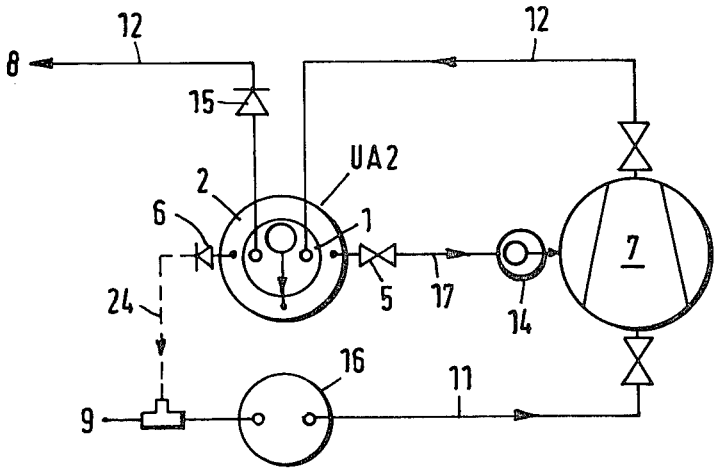
FIG. 7 is a flow diagram of a single circuit refrigeration plant with a one-stage compressor and two concentrically arranged operating spaces.

FIG. 7 shows the flow diagram for a single circuit refrigerating plant with one-stage compressor (7) and device UA2, the function contents OeS (1) and E (2) have been made the base for its two operating spaces. Thus the following effective correlations result:

The stream of freezing mixture of the refrigerating circuit, produced by the refrigerating compressor (7) enters the OeS operating space (1) first as a pressure gas volume stream (V) via the pressure gas line (12). There the compressor oil, carried along by the pressure gas volume stream is almost completely separated and is conveyed under pressure gas pressure (p) into the E-operating space (2) in the rythm of operationally obtained quantity. Here the pressure gas dissolved in the oil is relaxed at low pressure ($(po+\Delta p)<p$) and is carried off via a degassing valve (6) and degassing line (24) to the producer gas line (11). The oil, degassed and stored in the E-operating space (2) is cooled down by the cooling effect of the ambient air ($t\ air<tE$).

The pressure gas-volume stream (V) reaches the condensor (8) from the OeS-operating space (1) via a series connected return valve (15) in the pressure gas line (12).

The evaporated freezing mixture enters the refrigerating compressor (7) from the evapoator (9) as a producer gas volume stream (Vo) via the producer gas line (11) and plant fluid separator (16).

The degassed and cooled down return oil, stored in the E-operating space (2) reaches the crank pit of the refrigerating compressor (7) under constant differential pressure ($\Delta p$) through an outlet and cutoff valve (5) and oil return line (17) via an oil level regulator (14).

Figure 8:
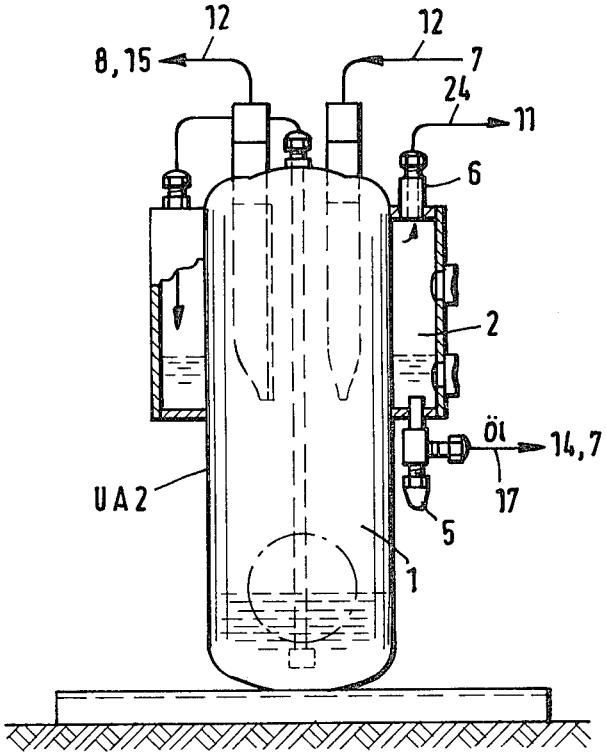
FIG. 8 is a schematic representation of the apparatus that is diagrammed in FIG. 7.

FIG. 8 shows an embodiment of a device UA2 according to FIG. 7.

The operating space 3 with the Venturi nozzle schematically rendered in FIGS. 3, 5 and 6, is preferably developed corresponding to the fluid separator with exhaust nozzle, described in the German OS No. 2 602 582.

Beside the various arrangements and places of the operating spaces shown in the figures, the following operating space positions may be provided, whereby places and arrangements are moreover permutative in all the individual cases: Side by side, superposed, concentrically superposed, concentrically side by side and superposed.

Beside these different positions of the operating spaces a basically star-shaped arrangement may be provided, whereby the operating spaces may be disposed in the form of a rectangle or a square or as sectors of a circular cross-section, so that one operating space always adjoins two adjacent operating spaces.

I claim:

1. In a single circuit refrigeration plant in which a gas stream, while flowing in the circuit is compressed by a compressor which injects oil into the gas stream while compressing the gas, circulated from the pressure side of the compressor and through a condenser, then through an evaporator and finally back to the suction side of the compressor, an apparatus improvement, comprising:

a housing having wall means defining four concentrically located contiguous compartments, each being interposed in said single circuit at a respectively different relative location as follows:

(a) a first compartment being interposed between the pressure side of the compressor and the condenser;

(b) a second compartment being interposed between the first compartment and a third compartment;

(c) said third compartment being interposed between the evaporator and the suction side of the compressor; and (d) a fourth compartment being interposed between the condenser and the evaporator;

there being further provided in said circuit a degassing valve between the second and third compartments, a non-return valve between the first compartment and the condenser, and a cut-off valve between the fourth compartment and the evaporator;

there being further provided a float valve means connecting said first compartment with the second compartment for delivering pressurized oil separating from said compressed gas stream in said first compartment to said second compartment; conduit means for delivering degassified oil collecting in the second compartment back to the compressor;

the first compartment being axially centrally located and directly ringed by both the second and third compartments which axially adjoin one another, and the fourth compartment ringing the third compartment, so that, in operation;

as the compressed gas stream enters the first compartment the pressurized oil therein separates therefrom and the resultingly de-oiled compressed gas stream flows to and through the condenser and back to the fourth compartment as a freezing mixture fluid which while in the fourth compartment becomes undercooled at least in part by indirect heat transfer by contact with the third compartment; meanwhile, the oil degassed and collected in the second compartment is cooled at least in part by indirect heat transfer by contact with the third compartment and is returned to the compressor; the undercooled freezing mixture fluid is collected in the fourth compartment which flows to and through the evaporator, then flows as a liquid component and a gas stream component to the third compartment, in which the liquid component is separated and combined with the gas that was degassed from the oil in the second compartment, and the remaining gas stream is returned to the suction side of the compressor, so that the four compartments serve the following principal functions:

oil is separated from compressed gas in the first compartment;

separated oil is degassed in the second compartment;

liquid is separated from the gas stream in the third compartment; and fluid coming from the condenser is collected in the fourth compartment.

2. In a single circuit refrigeration plant in which a gas stream, while flowing in the circuit, is compressed by a compressor which injects oil into the gas stream while compressing the gas stream, circulated from the pressure side of the compressor and through a condensor, then through an evaporator and finally back to the suction side of the compressor, an apparatus improvement, comprising:

a housing having wall means defining three concentrically located contiguous compartments, each being interposed in said single circuit at a respectively different relative location as follows:

(a) a first compartment being interposed between the pressure side of the compressor and the condenser;

(b) a second compartment being interposed between the first compartment and a third compartment; and (c) said third compartment being interposed between the second compartment and the evaporator;

there being further provided in said circuit a degassing valve between the second and third compartments, a non-return valve between the first compartment and the condenser, a fluid collector between the condenser and the evaporator and a cut-off valve between the fluid collector and the evaporator;

there being further provided a float valve means connecting said first compartment with said second compartment for delivering pressurized oil separating from said compressed gas stream in said first compartment to said second compartment; conduit means for delivering degassified oil collecting in the second compartment back to the compressor;

the first compartment being axially centrally located and directly ringed by the third compartment and ringed by the second compartment, so that, in operation:

as the compressed gas stream enters the first compartment the pressurized oil therein separates therefrom and the resultingly de-oiled compressed gas stream flows to and through the condenser, through the fluid collector, to and through the evaporator to the third compartment in which it separates into a further liquid component which is combined with the degassed oil in the second compartment, and the remaining gas stream is returned to the suction side of the compressor, meanwhile: the oil degassed and collected in the second compartment is cooled at least in part by indirect heat transfer by contact with the third compartment and is returned to the compressor, so that the three compartments serve the following principal functions:

oil is separated from compressed gas in the first compartment;

separated oil is degassed in the second compartment;

liquid is separated from freezing mixture fluid in the third compartment.

3. The apparatus improvement of claim 2, wherein:

the first compartment is directly ringed by the second compartment and the second and third compartments are axially adjoining.

4. The apparatus improvement of claim 2, wherein:

the third compartment is directly ringed by the second compartment and the second and third compartments are radially adjoining so that the second compartment indirectly rings the first compartment.

* * * * *